US007286037B2

(12) United States Patent
Furuuchi

(10) Patent No.: US 7,286,037 B2
(45) Date of Patent: Oct. 23, 2007

(54) PROTECTIVE ELEMENT

(75) Inventor: Yuji Furuuchi, Tochigi (JP)

(73) Assignees: Sony Corporation, Tokyo (JP); Sony Chemical and Information Device Corporation, Tokyo (JP)

( * ) Notice: Subject to any disclaimer, the term of this patent is extended or adjusted under 35 U.S.C. 154(b) by 321 days.

(21) Appl. No.: 10/537,908

(22) PCT Filed: Dec. 5, 2003

(86) PCT No.: PCT/JP03/15604

§ 371 (c)(1),
(2), (4) Date: Jun. 8, 2005

(87) PCT Pub. No.: WO2004/061886

PCT Pub. Date: Jul. 22, 2004

(65) Prior Publication Data

US 2006/0028314 A1 Feb. 9, 2006

(30) Foreign Application Priority Data

Dec. 27, 2002 (JP) ..... 2002-382569

(51) Int. Cl.
*H01H 85/06* (2006.01)
*H01H 85/055* (2006.01)

(52) U.S. Cl. ..... 337/290; 337/296; 337/159; 337/416

(58) Field of Classification Search ..... 337/290, 337/296, 159, 416, 4; 29/623; 219/517
See application file for complete search history.

(56) References Cited

U.S. PATENT DOCUMENTS 5,097,247 A * 3/1992 Doerrwaechter ..... 337/405
5,367,280 A * 11/1994 Thiel et al. ..... 337/297
5,712,610 A * 1/1998 Takeichi et al. ..... 337/290
5,880,666 A 3/1999 Matsuoka et al.
5,939,969 A * 8/1999 Doerrwaechter et al. ... 337/297
6,040,754 A * 3/2000 Kawanishi ..... 337/297
6,114,672 A * 9/2000 Iwasaki et al. ..... 219/505
6,269,745 B1 * 8/2001 Cieplik et al. ..... 102/202.5

(Continued)

FOREIGN PATENT DOCUMENTS

EP 1 045 418 A2 10/2000

(Continued)

*Primary Examiner*—Anatoly Vortman
(74) *Attorney, Agent, or Firm*—Oliff & Berridge, PLC

(57) ABSTRACT

A protective element with improved spherical segmentation performance during the melting of a low-melting metal member, has a heat-generating member and a low-melting metal member on a substrate, in which the low-melting metal member is heated and blown out by the heat generated by the heat-generating member. There is a region in which the low-melting metal member is suspended over the underlying base (such as an insulating layer), and when S ($\mu m^2$) is the surface area of a lateral cross section of the low-melting metal member 4 between a pair of low-melting metal member electrodes 3*a* and 3*b* or 3*b* and 3*c* sandwiching the region, and H (μm) is the height at which the suspended region is suspended, then the relationship $H/S \geqq 5\times10^{-5}$ is satisfied. It is preferable here that the upper surfaces of both of the pair of low-melting metal member electrodes protrude beyond the upper surface of the underlying insulating layer.

4 Claims, 6 Drawing Sheets

( x − x cross section )

( y − y cross section )

U.S. PATENT DOCUMENTS

| | | | | |
|---|---|---|---|---|
| 6,351,361 | B1 * | 2/2002 | Kawazu et al. | 361/103 |
| 6,373,371 | B1 * | 4/2002 | Doerrwaechter et al. | 337/297 |
| 6,452,475 | B1 | 9/2002 | Kawazu et al. | |
| 6,566,995 | B2 * | 5/2003 | Furuuchi et al. | 337/183 |
| 2001/0044168 | A1 | 11/2001 | Furruchi et al. | |

FOREIGN PATENT DOCUMENTS

| | | | |
|---|---|---|---|
| JP | A 8-161990 | | 6/1996 |
| JP | A 10-112252 | | 4/1998 |
| JP | A 10-116549 | | 5/1998 |
| JP | A 10-116550 | | 5/1998 |
| JP | 10162714 | A * | 6/1998 |
| JP | B2 2790433 | | 6/1998 |
| JP | 11339615 | A * | 12/1999 |
| JP | A 2000-306477 | | 11/2000 |
| JP | A 2001-325868 | | 11/2001 |
| JP | A 2001-325869 | | 11/2001 |
| JP | 2003217416 | A * | 7/2003 |

* cited by examiner ( x − x cross section )

( y − y cross section )

1 A ( x − x cross section )

1 E

1 F ( x − x cross section )

PROTECTIVE ELEMENT

TECHNICAL FIELD

This invention relates to a protective element in which a heat-generating member generates heat that blows out a low-melting metal member when current passes through the heat-generating member in the event of a malfunction.

BACKGROUND ART

Current fuses composed of a low-melting metal member of lead, tin, antimony or the like are commonly known as protective elements for cutting off over-current.

Protective elements that can be used to prevent not only for over-current but also overvoltage are also known, in which a heat-generating member and a low-melting metal member are layered in that order on a substrate, the heat-generating member generates heat in the event of overvoltage, and this heat blows out the low-melting metal member (Japanese Patent 2,790,433).

However, when an insulating layer is formed by screen printing in such a protective element, the mesh used in the screen printing makes the surface of the insulating layer uneven, and this unevenness has been indicated as a problem in that they hinder smooth, spherical segmenting during the heating of the low-melting metal member layered over the insulating layer. To deal with this problem, it has been proposed that the heat-generating member and the low-melting metal member be disposed in planar fashion on the substrate, with no insulating layer interposed in between them (Japanese Patent Applications Laid-Open Nos. H10-116549 and H10-116550).

However, disposing the heat-generating member and the low-melting metal member in planar fashion makes it impossible to produce a more compact element. Also, since here again the low-melting metal member is provided so as to be in solid contact with the substrate, the substrate inevitably hinders the flow of the low-melting metal member in a molten state, which means that smooth, spherical segmenting of the low-melting metal member cannot be guaranteed.

In view of this, it is an object of the present invention to ensure consistent spherical segmenting of the low-melting metal member during melting, in a protective element comprising a heat-generating member and a low-melting metal member on a substrate, and in which the low-melting metal member is heated and blown out by the heat generated by the heat-generating member.

DISCLOSURE OF THE INVENTION

The inventor discovered that if a low-melting metal member is suspended between electrodes connected to the low-melting metal member over a substrate, and if the height H of the suspension in this case and the surface area S of a lateral cross section of the low-melting metal member are in a specific relationship, there is an improvement in the spherical segmentation performance during the melting of the low-melting metal member.

Specifically, the present invention provides a protective element comprising a heat-generating member and a low-melting metal member on a substrate, in which the low-melting metal member is blown out by the heat generated by the heat-generating member, wherein there is provided a region in which the low-melting metal member is suspended over the underlying base, and when S ($\mu m^2$) is the surface area of a lateral cross section of the low-melting metal member between a pair of low-melting metal member electrodes sandwiching the region, and H (μm) is the height at which the suspended region is suspended, then $H/S \geqq 5\times 10^{-5}$.

The "lateral cross section of the low-melting metal member" here refers to a cross section of the low-melting metal member that is perpendicular to the direction of current flowing through the low-melting metal member.

BEST MODE FOR CARRYING OUT THE INVENTION

Figure 1A:
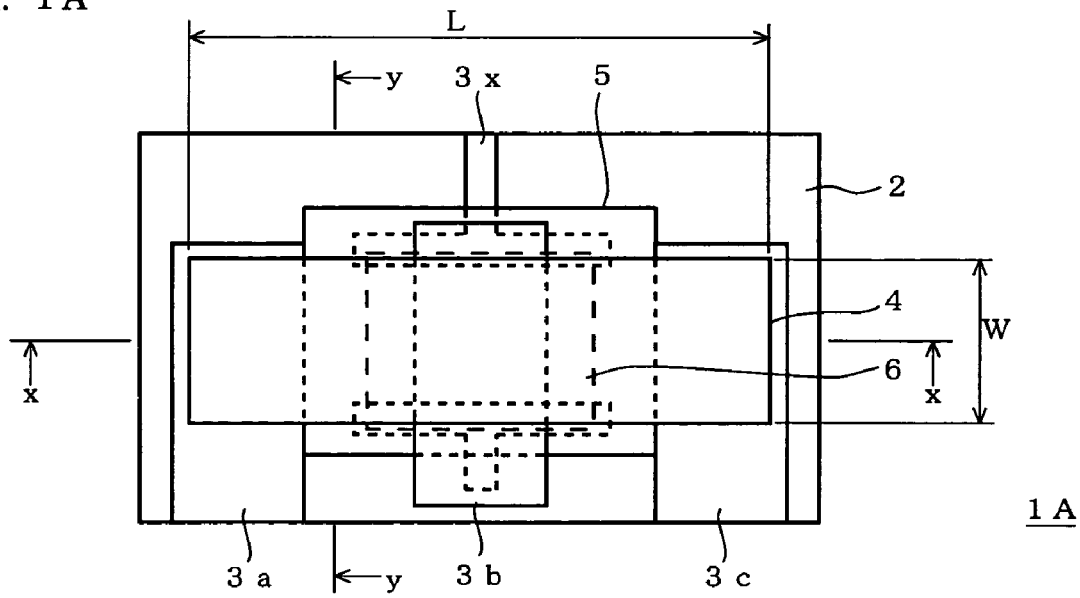
FIG. 1A is a plan view of a protective element of the present invention.

The present invention will now be described in detail through reference to the drawings. Numbering in the drawings is the same for identical or equivalent constituent elements.

Figure 1B:
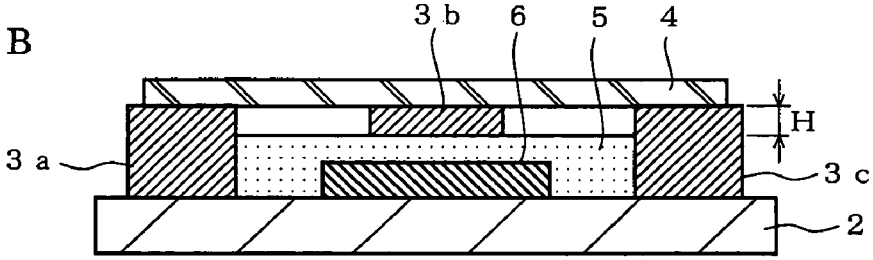
FIGS. 1B and 1C are cross sections thereof.
Figure 1C:
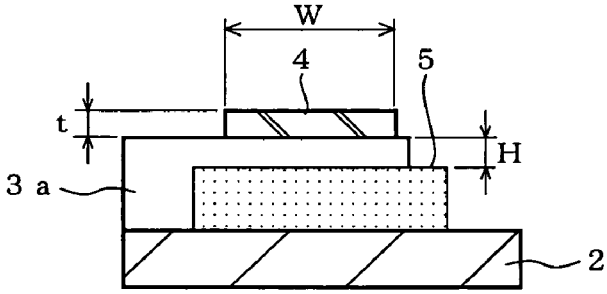
Figure 2A:
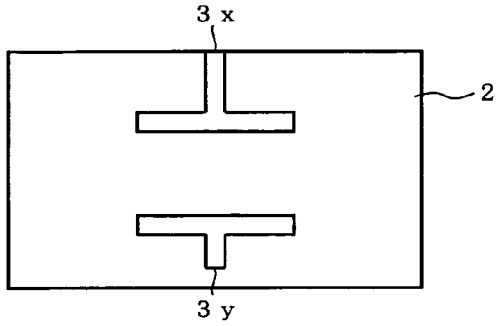
FIGS. 2A to 2E are diagrams of the manufacturing process for a protective element of the present invention.
Figure 2B:
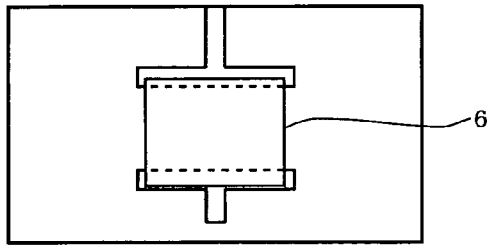
Figure 2C:
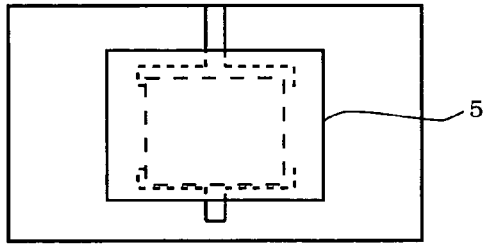
Figure 2D:
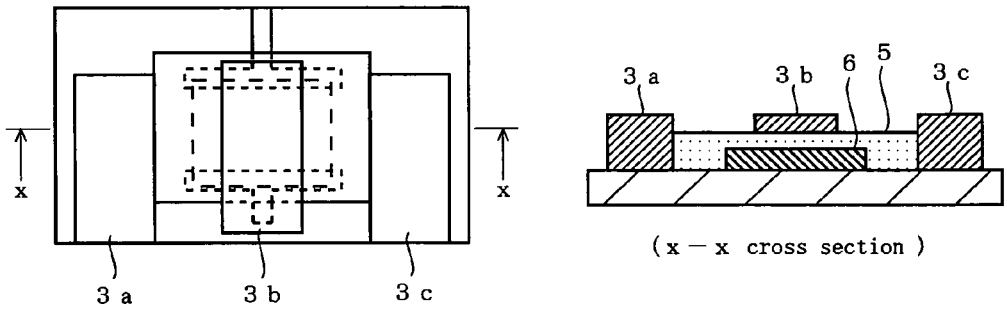
Figure 2E:
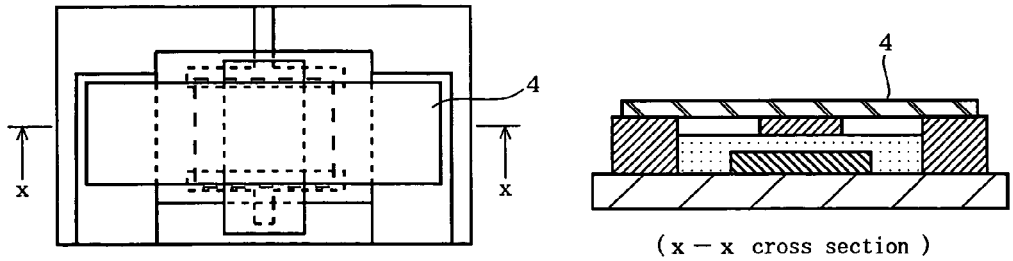

FIG. 1A is a plan view of a protective element 1A of the present invention, and FIGS. 1B and 1C are cross sections thereof.

This protective element 1A has a structure in which a heat-generating member 6, an insulating layer 5, and a low-melting metal member 4 are layered in that order on a substrate 2. Here, the low-melting metal member 4 is connected at its ends to low-melting metal member electrodes 3*a* and 3*c* and at its middle to a low-melting metal member electrode 3*b*. The upper surfaces of these electrodes 3*a*, 3*b*, and 3*c* all protrude beyond the upper surface of the insulating layer 5, which lies under the low-melting metal member 4, so the low-melting metal member 4 is suspended without touching this underlying insulating layer 5.

This protective element 1A is characterized in that $H/S \geqq 5\times 10^{-5}$, where S ($\mu m^2$) is the surface area of a lateral cross section of the low-melting metal member 4 between the pair of low-melting metal member electrodes 3*a* and 3*b* or the electrodes 3*b* and 3*c* (the portion in FIG. 1C that is hatched with double lines; W×t), and H (μm) is the height at which the suspended region is suspended.

As a result, when the low-melting metal member 4 is heated to a molten state by the heat generated by the heat-generating member 6, the low-melting metal member 4 consistently undergoes spherical segmentation, regardless of the surface condition of the underlying insulating layer 5, substrate 2, etc.

This protective element 1A is manufactured as shown in FIG. 2. First, electrodes (so-called cushion electrodes) 3*x* and 3*y* for the heat-generating member 6 are formed on the substrate 2 (FIG. 2A), and then the heat-generating member 6 is formed (FIG. 2B). This heat-generating member 6 is formed, for example, by printing and baking a ruthenium oxide-based paste. Next, if needed, the heat-generating member 6 is trimmed with an excimer laser or the like in order to adjust the resistance of the heat-generating member 6, after which the insulating layer 5 is formed so as to cover the heat-generating member 6 (FIG. 2C). The low-melting metal member electrodes 3*a*, 3*b*, and 3*c* are then formed (FIG. 2D), and the low-melting metal member 4 is provided so as to bridge these electrodes 3*a*, 3*b*, and 3*c* (FIG. 2E).

The forming materials of the substrate 2, the electrodes 3*a*, 3*b*, 3*c*, 3*x*, and 3*y*, the heat-generating member 6, the insulating layer 5, the low-melting metal member 4, and the methods for forming these, can be the same as in prior art. Therefore, for example, the substrate 2 can be formed of a plastic film, glass epoxy substrate, ceramic substrate, metal substrate, or the like, and is preferably an inorganic substrate.

The heat-generating member 6 can be formed by coating the substrate with a resistor paste composed of a conductive material such as ruthenium oxide or carbon black, and an inorganic binder (such as water glass) or an organic binder (such as a thermosetting resin), and baking this coating if needed. The heat-generating member 6 may also be formed by printing, plating, vapor depositing, sputtering, or otherwise providing a thin film such as ruthenium oxide or carbon black, or by sticking on a film of these materials, laminating them, etc.

Any of the various low-melting metal members used in the past as fuse materials can be used as the material for forming the low-melting metal member 4. For example, the alloys listed in Table 1 in paragraph [0019] of Japanese Patent Application Laid-Open No. H8-161990 can be used.

The low-melting metal member electrodes 3*a*, 3*b*, and 3*c* can be made of copper or another such metal alone, or can be plated on their surface with Ag—Pt, gold, or the like.

Figure 3:
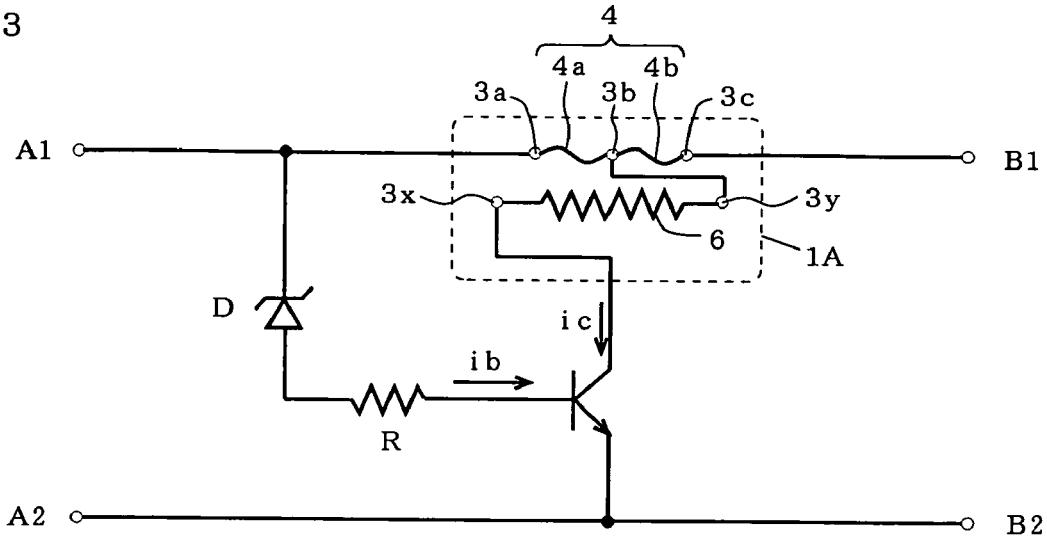
FIG. 3 is a circuit diagram of an overvoltage prevention apparatus.

As shown in FIG. 3, an overvoltage prevention apparatus is an example of how the protective element 1A in FIG. 1A can be used. In the overvoltage prevention apparatus of FIG. 3, the electrode terminals of the device such as a lithium ion cell to be protected, are connected to terminals A1 and A2, and the electrode terminals of the charger or other such device that is connected to the device to be protected are connected to terminals B1 and B2. With this overvoltage prevention apparatus, if reverse voltage over the breakdown voltage is applied to a Zener diode D as the charging of the lithium ion cell proceeds, a base current ib flows suddenly, which causes a large collector current ic to flow to the heat-generating member 6, and the heat-generating member 6 generates heat. This heat is transmitted to the low-melting metal member 4 over the heat-generating member 6, the low-melting metal member 4 is blown out, and overvoltage is prevented from being applied to the terminals A1 and A2. In this case, the low-melting metal member 4 is blown out at two places (4*a* and 4*b*), so the flow of power to the heat-generating member 6 is completely cut off after the blow-out.

The protective element of the present invention can also assume various other aspects. For instance, a height differential can be provided between the upper surfaces of the pair of low-melting metal member electrodes, so that the low-melting metal member connected to the pair of low-melting metal member electrodes is inclined between these electrodes.

Figure 4:
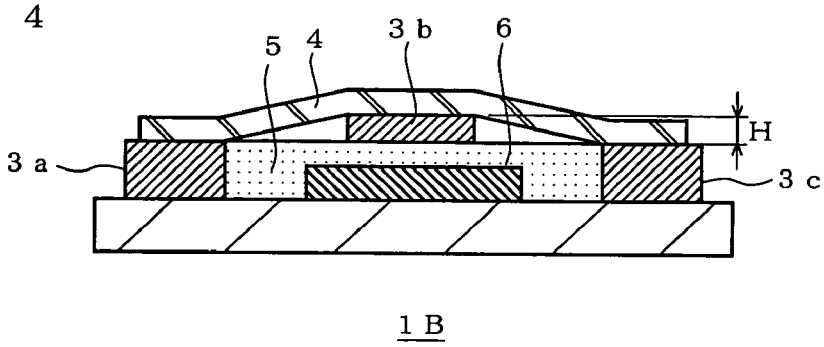
FIG. 4 is a cross section of a protective element of the present invention.

The protective element 1B in FIG. 4 is an example of such a protective element. The upper surface of the middle electrode 3*b* protrudes beyond the upper surfaces of the electrodes 3*a* and 3*c* at the ends, and the low-melting metal member 4 linking the electrodes 3*a*, 3*b*, and 3*c* is inclined so that a bulge is formed on the top side of the protective element 1B. In this case, the suspension height H (μm), which is determined by the height differential between the upper surface of the middle electrode 3*b* and the electrodes 3*a* and 3*c* at the ends, and the surface area S ($\mu m^2$) of a lateral cross section of the low-melting metal member satisfy the relationship $H/S \geqq 5\times10^{-5}$. Suspending the low-melting metal member 4 at an angle in this manner affords more consistent spherical segmentation during melting.

Figure 5:
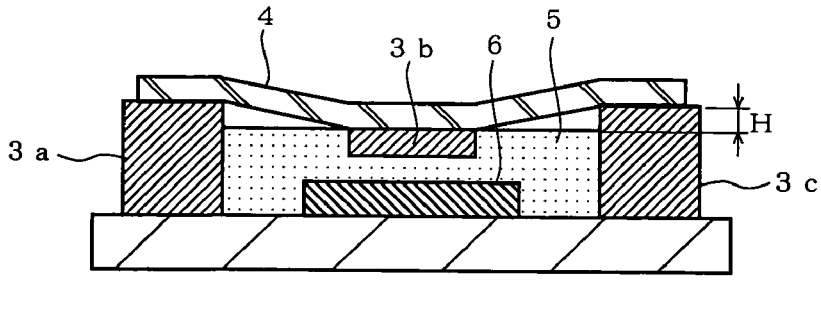
FIG. 5 is a cross section of a protective element of the present invention.

With the protective element 1C in FIG. 5, the upper surface of the middle electrode 3*b* is formed lower than the upper surfaces of the electrodes 3*a* and 3*c* at the ends, and the low-melting metal member 4 linking the electrodes 3*a*, 3*b*, and 3*c* is inclined so as to form a bulge on the bottom side of the protective element. Here again, the suspension height H (μm), which is determined by the height differential between the upper surface of the middle electrode 3*b* and the electrodes 3*a* and 3*c* at the ends, and the surface area S ($\mu m^2$) of a lateral cross section of the low-melting metal member satisfy the relationship $H/S \geqq 5\times10^{-5}$. For the upper surface of the middle electrode 3*b* to be formed in the same plane as the upper surface of the insulating layer 5, as with this protective element 1C, for example, a glass paste is printed to form the insulating layer 5, over which a conductive paste is printed to form the electrode 3*b*, these printed surfaces are brought into the same plane by pressing, and then a baking treatment is performed to form the insulating layer 5 and the electrode 3*b*.

Figure 6A:
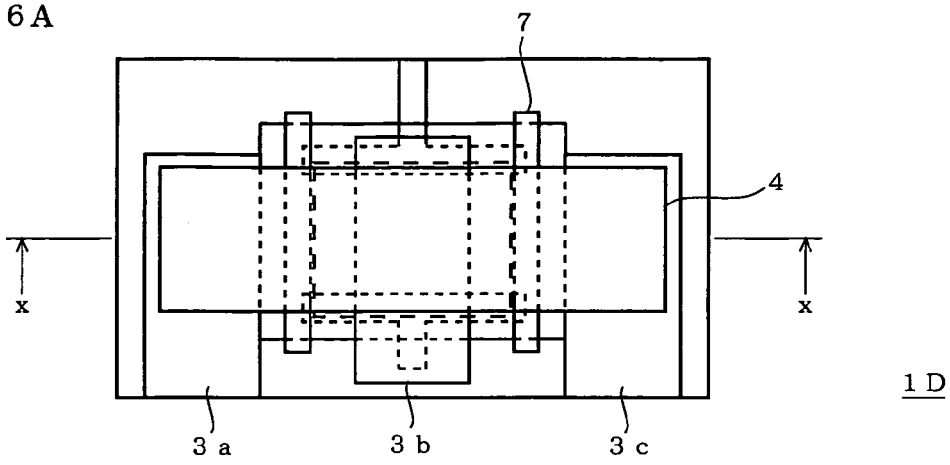
FIG. 6A is a plan view of a protective element of the present invention.
Figure 6B:
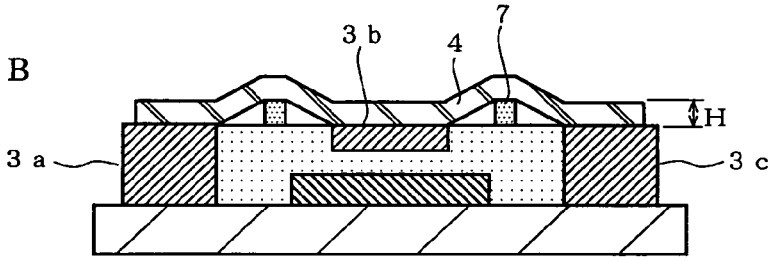
FIG. 6B is a cross section thereof.

With the protective element 1D in FIG. 6A, spacers 7 composed of insulating glass or the like are provided between the middle electrode 3*b* and the electrodes 3*a* and 3*c* at the ends, and the low-melting metal member 4 is formed over these spacers 7, so that the low-melting metal member 4 is suspended by these spacers. In this case, the suspension height H (μm), which is determined by the height differential between the upper surfaces of the spacers 7 and the upper surface of the middle electrode 3*b* or the upper surfaces of the electrodes 3*a* and 3*c* at the ends, and the surface area S ($\mu m^2$) of a lateral cross section of the low-melting metal member 4 satisfy the relationship $H/S \geqq 5\times10^{-5}$.

Figure 7:
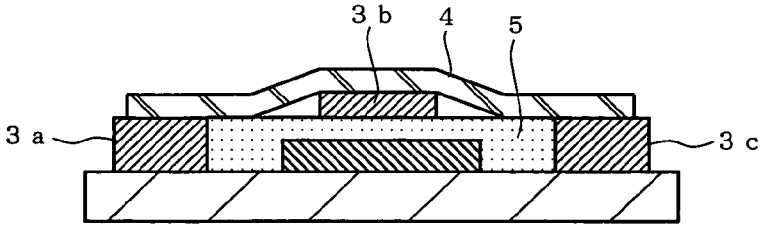
FIG. 7 is a cross section of a protective element of the present invention.

With the protective elements 1A, 1B, 1C, and 1D discussed above, the low-melting metal member 4 is suspended over the entire region between the electrodes 3*a* and 3*b* and between the electrodes 3*b* and 3*c*, and the low-melting metal member is not in contact with the insulating layer 5 below, but in the present invention the low-melting metal member 4 does not necessarily have to be suspended over the entire region other than where it touches the electrodes 3*a*, 3*b*, and 3*c*. For example, with the protective element 1E shown in FIG. 7, the low-melting metal member 4 touches the insulating layer 5 in the vicinity of the electrodes 3*a* and 3*c* at the ends.

Figure 8:
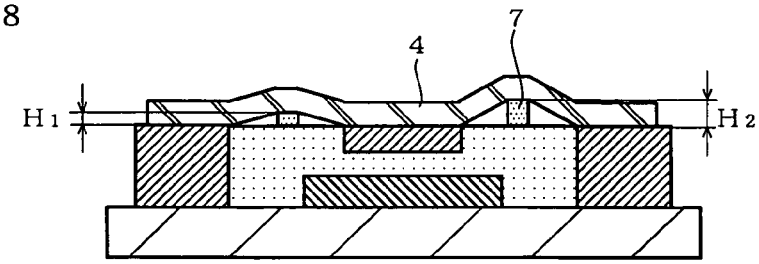
FIG. 8 is a cross section of a protective element of the present invention.

Also, if there are different suspension heights ($H_1$ and $H_2$) of the low-melting metal member 4 within a single protective element, as with the protective element 1F shown in FIG. 8, the above-mentioned suspension height H and the surface area S of a lateral cross section of the low-melting metal member will satisfy the above relationship for each suspension.

Figure 9A:
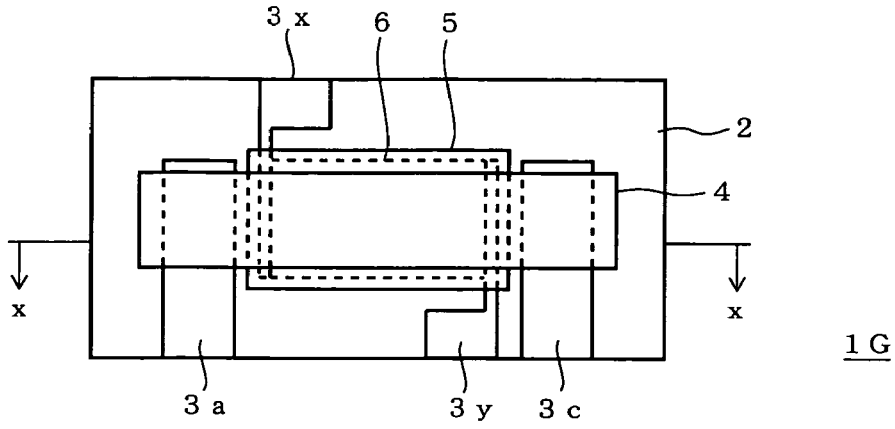
FIG. 9A is a plan view of a protective element of the present invention.
Figure 9B:
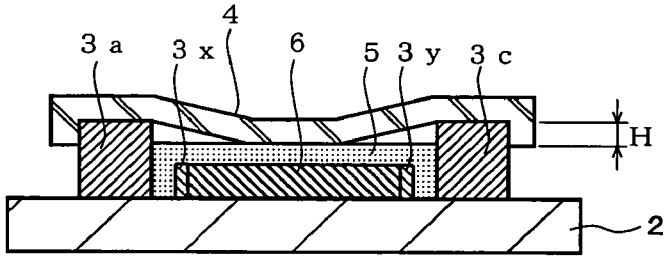
FIG. 9B is a cross section thereof.
Figure 10:
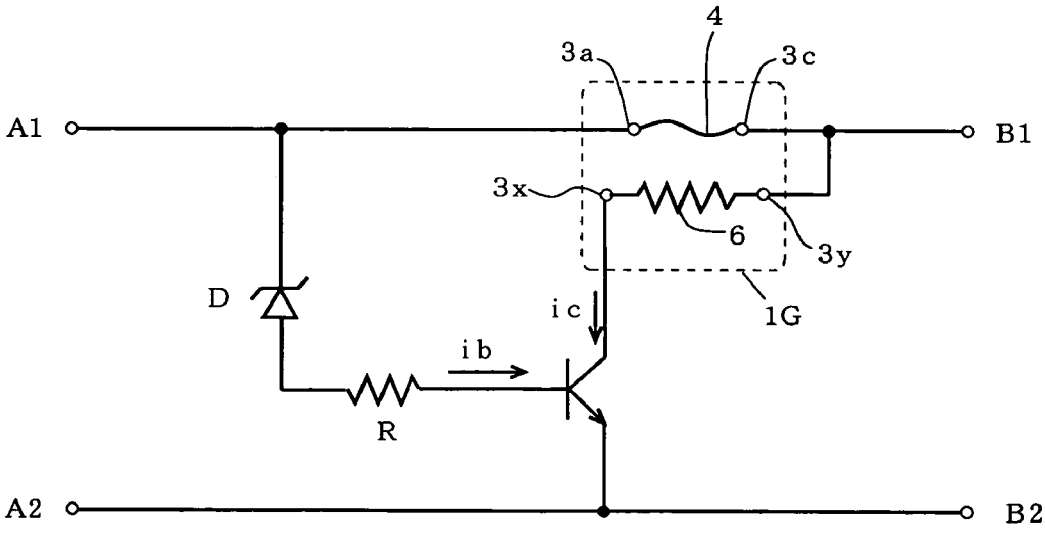
FIG. 10 is a circuit diagram of an overvoltage prevention apparatus.

With the protective element of the present invention, the low-melting metal member is not limited to a type that is blown out between two pairs of electrodes, such as between the electrodes 3*a* and 3*b* and between the electrodes 3*b* and 3*b*, and may be configured such that it is blown out only between one pair of electrodes, as dictated by the application. For instance, a protective element that is used in an overvoltage prevention device in the circuit diagram shown in FIG. 10 can be configured such that the electrode 3*b* is eliminated, as with the protective element 1G shown in FIG. 9A. This protective element 1G also has a suspension of height H between the pair of electrodes 3*a* and 3*c*.

In addition, the shape of the individual low-melting metal members 4 in the protective element of the present invention is not limited to being flat. For example, the shape may be that of a round rod. Also, the low-melting metal member 4 is not limited to being layered over the heat-generating member 6 via the insulating layer 5. The low-melting metal member and the heat-generating member may be disposed in-plane, and the low-melting metal member blown out by the heat generated by the heat-generating member.

When the protective element of the present invention is incorporated in a chip, it is preferable to cover the low-melting metal member 4 with a cap of 4,6-nylon, a liquid crystal polymer, or the like.

EXAMPLES

The present invention will now be described in specific terms through examples.

Example 1

The protective element 1A in FIG. 1A was produced as follows. An alumina-based ceramic substrate (0.5 mm thick and measuring 5 mm×3 mm) was readied as the substrate 2, on which was printed a silver-palladium paste (6177T made by DuPont), and this coating was baked (0.5 hour at 850° C.) to form electrodes 3*x* and 3*y* (10 μm thick and measuring 2.4 mm×0.2 mm) for the heat-generating member 6.

Next, this was printed with a ruthenium oxide-based paste (DP1900 made by DuPont), and this coating was baked (0.5 hour at 850° C.) to form the heat-generating member 6 (10 μm thick and measuring 2.4 mm×1.6 mm; pattern resistance of 5 Ω).

After this, the insulating layer 5 (15 μm thick) was formed over the heat-generating member 6 by printing an insulating glass paste. The low-melting metal member electrodes 3*a*, 3*b*, and 3*c* (measuring 2.2 mm×0.7 mm; 3*a* and 3*c* were 20 μm thick, and 3*b* was 10 μm thick) were then formed by printing a silver-platinum paste (5164N made by DuPont) and baking (0.5 hour at 850° C.). These electrodes 3*a*, 3*b*, and 3*c* were connected with a solder foil (Sn:Sb=95:5, liquid phase point: 240° C., thickness t=100 μm, length L=4000 μm, width W=1000 μm) as the low-melting metal member 4. This yielded the protective element 1A, in which the suspension height H of the solder foil was 10 μm, and the surface area S of a lateral cross section of the solder foil was 100 μm×1000 μm=$1\times10^5$ $\mu m^2$.

Comparative Example 1

Figure 11:
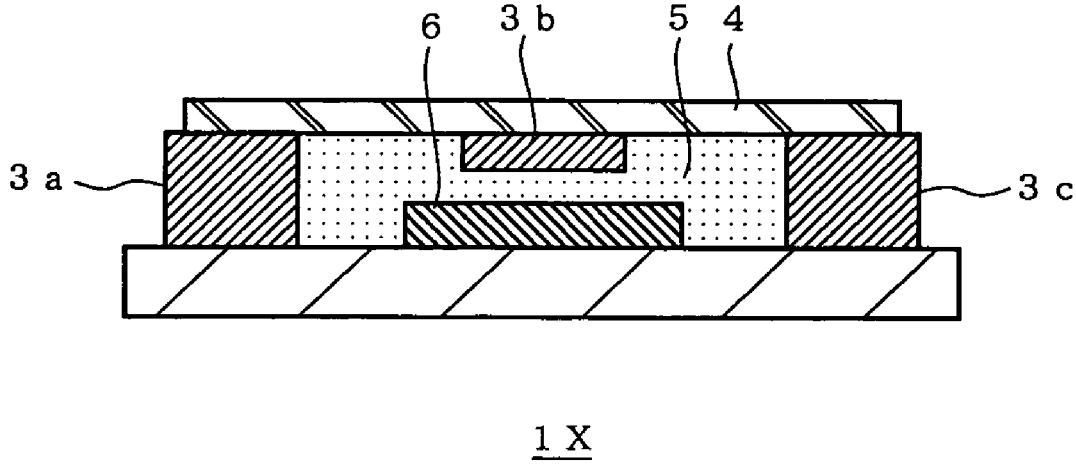
FIG. 11 is a cross section of a protective element in a comparative example.

A protective element 1X with no suspension of the solder foil (the low-melting metal member 4), as shown in FIG. 11, was produced in the same manner as in the method for manufacturing the protective element in Example 1, except that the electrodes 3*a*, 3*b*, and 3*c* were pressed into the same plane as the insulating layer 5 prior to the baking of the electrodes 3*a*, 3*b*, and 3*c*, and the solder foil was connected thereover.

Examples 2 to 7 and Comparative Examples 2 to 5

Protective elements with different suspension heights H of the low-melting metal member and lateral cross sectional areas S, as shown in Table 1, were produced by varying the printing thickness of the electrodes 3*a*, 3*b*, and 3*c* and the width and thickness of the low-melting metal member 4 in the method for manufacturing the protective element of Example 1.

Evaluation

When 4 W was applied to the heat-generating member 6 of each of the protective elements in Examples 1 to 7 and Comparative Examples 1 to 5, the time from the application of voltage to the heat-generating member 6 until the low-melting metal member 4 was blown out (operating time) was measured, and the rating was G if the operating time was 15 seconds or less, and NG if longer than 15 seconds.

These results are given in Table 1. It can be seen from Table 1 that the operating time is shorter when a suspended region is provided to the low-melting metal member 4, and that the operating time is 15 seconds or less when the ratio H/S between the suspension height H of the low-melting metal member 4 and the lateral cross sectional surface area S is at least $5\times10^{-5}$.

TABLE 1

| | Width W (μm) | Thickness t (μm) | Area S ($\mu m^2$) | Suspension height H (μm) | H/S | Operating time (sec) | Rating |
|---|---|---|---|---|---|---|---|
| Ex. 1 | 1000 | 100 | 100,000 | 10 | $1.0 \times 10^{-4}$ | 10 | G |
| Ex. 2 | 1000 | 100 | 100,000 | 5 | $5.0 \times 10^{-5}$ | 13 | G |
| Ex. 3 | 1000 | 150 | 150,000 | 10 | $6.7 \times 10^{-5}$ | 12 | G |
| Ex. 4 | 1000 | 300 | 300,000 | 20 | $6.7 \times 10^{-5}$ | 15 | G |
| Ex. 5 | 500 | 150 | 75,000 | 5 | $6.7 \times 10^{-5}$ | 10 | G |
| Ex. 6 | 500 | 150 | 75,000 | 10 | $1.3 \times 10^{-4}$ | 9 | G |
| Ex. 7 | 500 | 300 | 150,000 | 10 | $6.7 \times 10^{-5}$ | 13 | G |
| C.E. 1 | 1000 | 100 | 100,000 | 0 | — | 30 | NG |
| C.E. 2 | 1000 | 100 | 100,000 | 0 | — | 21 | NG |
| C.E. 3 | 1000 | 150 | 150,000 | 5 | $3.3 \times 10^{-5}$ | 24 | NG |
| C.E. 4 | 1000 | 300 | 300,000 | 10 | $3.3 \times 10^{-5}$ | 25 | NG |
| C.E. 5 | 500 | 300 | 150,000 | 5 | $3.3 \times 10^{-5}$ | 25 | NG |

[C.E.: Comparative Example]

INDUSTRIAL APPLICABILITY

With the present invention, consistent spherical segmentation of a low-melting metal member can be achieved during the melting of the low-melting metal member in a protective element comprising a heat-generating member and a low-melting metal member on a substrate, in which the low-melting metal member is heated and blown out by the heat generated by the heat-generating member.

The invention claimed is:

1. A protective element, comprising a heat-generating member and a low-melting metal member on a substrate, in which the low-melting metal member is blown out by the heat generated by the heat-generating member, wherein there is provided a region in which the low-melting metal member is suspended over a underlying base, and when S ($\mu m^2$) is the surface area of a lateral cross section of the low-melting metal member between a pair of low-melting metal member electrodes sandwiching said region, and H (μm) is the height at which the suspended region is suspended, then $H/S \geqq 5\times10^{-5}$.

2. The protective element according to claim 1, wherein the upper surfaces of both of the pair of low-melting metal member electrodes protrude beyond the upper surface of an insulating layer which is the underlying base.

3. The protective element according to claim 1, wherein there is provided a height differential between the upper surfaces of the pair of low-melting metal member electrodes, and the low-melting metal member is inclined between said pair of low-melting metal member electrodes.

4. The protective element according to claim 1, wherein an insulating spacer is provided between the pair of low-melting metal member electrodes, and the upper surface of said spacer protrudes beyond the upper surfaces of the pair of low-melting metal member electrodes.

* * * * *